700 MS
343-[redacted] AU 256 EX
1/24/78 XR 4,070,676

United States Patent [19]

Sanford

[11] 4,070,676

[45] Jan. 24, 1978

[54] MULTIPLE RESONANCE RADIO FREQUENCY MICROSTRIP ANTENNA STRUCTURE

[75] Inventor: Gary G. Sanford, Boulder, Colo.

[73] Assignee: Ball Corporation, Muncie, Ind.

[21] Appl. No.: 620,196

[22] Filed: Oct. 6, 1975

[51] Int. Cl.[2] ..... H01Q 1/38

[52] U.S. Cl. ..... 343/700 MS; 343/829

[58] Field of Search ..... 343/829, 830, 846, 847, 343/700 MS

[56] References Cited

U.S. PATENT DOCUMENTS

| | | | |
|---|---|---|---|
| 2,990,546 | 6/1961 | Haas | 343/705 |
| 3,016,536 | 1/1962 | Fubini | 343/829 |
| 3,541,557 | 11/1970 | Miley | 343/767 |
| 3,573,831 | 4/1971 | Forbes | 343/846 |
| 3,713,165 | 1/1973 | Lagerlof et al. | 343/771 |
| 3,739,386 | 6/1973 | Jones | 343/708 |
| 3,803,623 | 4/1974 | Charlot | 343/700 MS |

FOREIGN PATENT DOCUMENTS

| | | | |
|---|---|---|---|
| 1,050,583 | 9/1953 | France | 343/705 |

*Primary Examiner*—Eli Lieberman
*Attorney, Agent, or Firm*—James D. Haynes

[57] ABSTRACT

A multiple resonance microstrip antenna radiator which includes a plurality of stacked electrically conductive element surfaces disposed above an electrically conductive reference surface with each element surface dimensioned so as to resonate at a different radio frequency. The various element surfaces are spaced one from another and from the reference surface with a dielectric material and an rf feed is attached to at least one of the element surfaces. Non-resonant element surfaces provide inductive capacitive coupling of rf energy to/from a resonant element surface.

24 Claims, 5 Drawing Figures

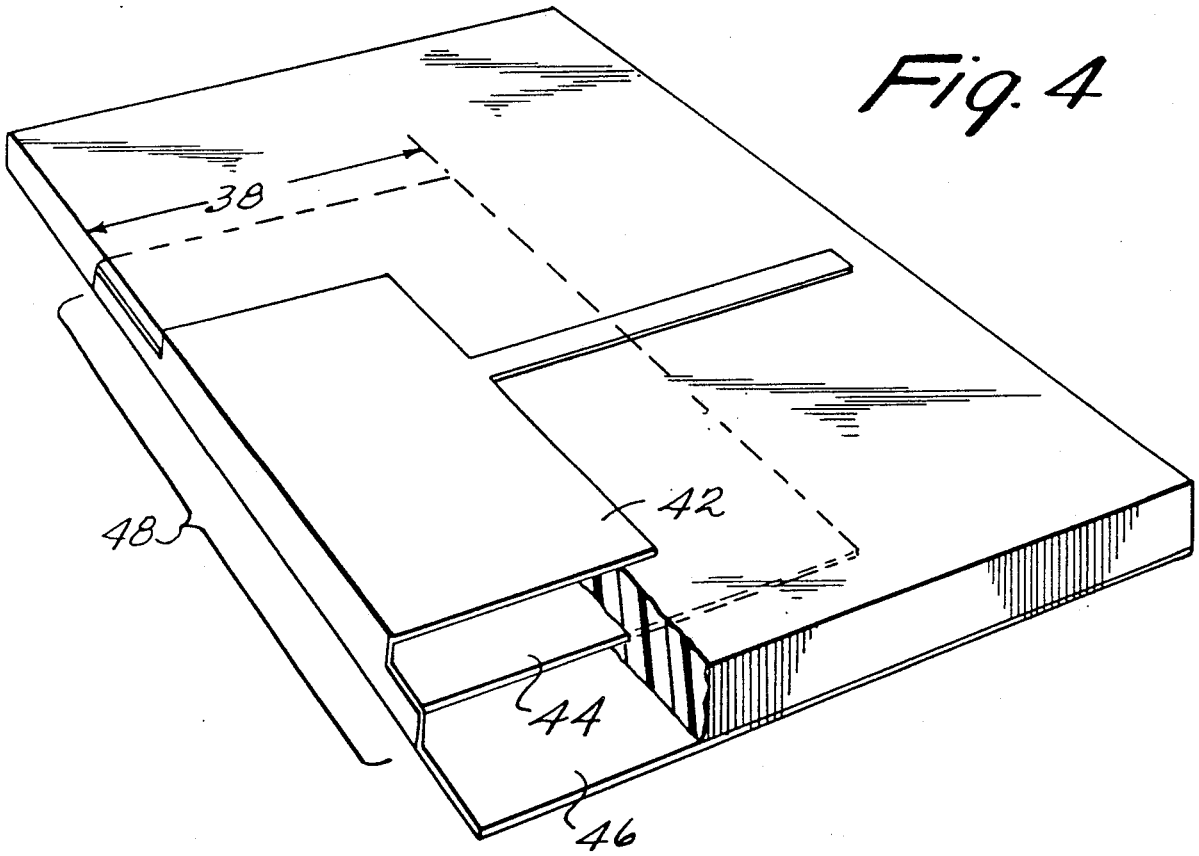
Fig. 4
Fig 5
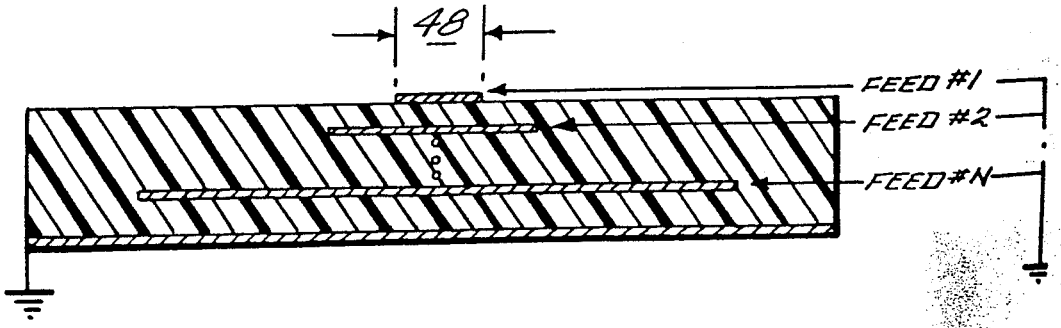

MULTIPLE RESONANCE RADIO FREQUENCY MICROSTRIP ANTENNA STRUCTURE

This invention generally relates to radio-frequency antenna structures and, more particularly, to multiple resonant microstrip antenna radiators.

Other microstrip radiator structures including some multiple resonant microstrip radiators have been disclosed in commonly assigned U.S. Pat. Nos. 3,713,162 issued Jan. 23, 1973; 3,810,183 issued May 7, 1974; 3,811,128 issued May 14, 1974 and also in commonly assigned copending United States application Ser. No. 352,005 filed Apr. 17, 1973. There is also a commonly assigned copending application of Russell W. Johnson for a microstrip radiator having multiple resonant axes. The microstrip radiator structures disclosed in these commonly assigned United States Patents and/or applications may be utilized as a component in the present invention.

As will be appreciated by those in the art, microstrip radiators, per se, are specially shaped and dimensioned conductive surfaces overlying a larger ground plane surface and spaced therefrom by a relatively small fraction of wavelength with a dielectric sheet. Typically, microstrip radiators are formed either singly or in arrays by photo-etching processes exactly similar to those utilized for forming printed circuit board structures of conductive surfaces. The starting material used in forming such microstrip radiators is also quite similar if not identical to conventional printed circuit board stock in that it comprises a dielectric sheet laminated between two conductive sheets. Typically, one side of such a structure becomes the ground or reference plane of a microstrip antenna while the other opposite surface spaced therefrom by the dielectric layer is photo-etched to form the actual microstrip radiator, per se, or some array of such radiators together with microstrip transmission feed lines thereto.

Typically, microstrip radiators exhibit a relatively narrow resonant bandwidth approximately on the order of two or three percent of the center resonant frequency. However, in many actual antenna applications, two or more operating frequencies are actually required, oftentimes separated by as much as five to twenty percent of a center frequency. A microstrip radiator does offer many advantages for such applications if it can be made to operate efficiently at all of the required frequencies.

In the past, this problem has been approached such as by forming the radiator with two orthogonal dimensions different from one another and therefor resonant at different frequencies. For instance, a rectangular element might be fed at a corner such that the shorter dimension of the rectangle would establish a first higher frequency resonance while the longer dimension of the rectangle would establish a second lower frequency resonance. A separate feed line for excitation of the long and short dimensions of such rectangles has also been accomplished. However, this approach is rather limited in the number of frequencies that can be accommodated and is limited to linear polarization where multiple frequencies are concerned. Furthermore, the linear polarizations of the two frequencies are necessarily different because of the different physical orientation of the different resonant dimensions.

Another approach to the multiple resonance microstrip radiator has been to employ different microstrip elements having the desired resonant frequencies arrayed together on a microstrip board and connected together via microstrip feed lines in such a way as to minimize the mutual effects. However, such mutual effects cannot be totally eliminated in such arrays and the net result is often a significant distortion of the desired radiation patterns. Furthermore, the surface area occupied by such multiple resonant arrays has in the past precluded their significant use in the larger aperture array structures.

Now, however, with the invention that has now been discovered and described herein, a microstrip radiator is provided which exhibits a potentially large number of multiple resonances with very little degradation of efficiency or changes in the radiation pattern with respect to shape, polarization or gain between the various resonances. Furthermore, the multiple resonant radiator of this invention is quite compact and therefore readily adapted for usage in larger aperture arrays.

These and other objects and advantages of this invention will become more clearly apparent from the following detailed description of the invention taken in conjunction with the accompanying drawings, of which:

FIG. 4 is a perspective partially cut away view of another exemplary embodiment of this invention; and FIG. 5 is a schematic cross-section of yet another exemplary embodiment of this invention.

Figure 1:
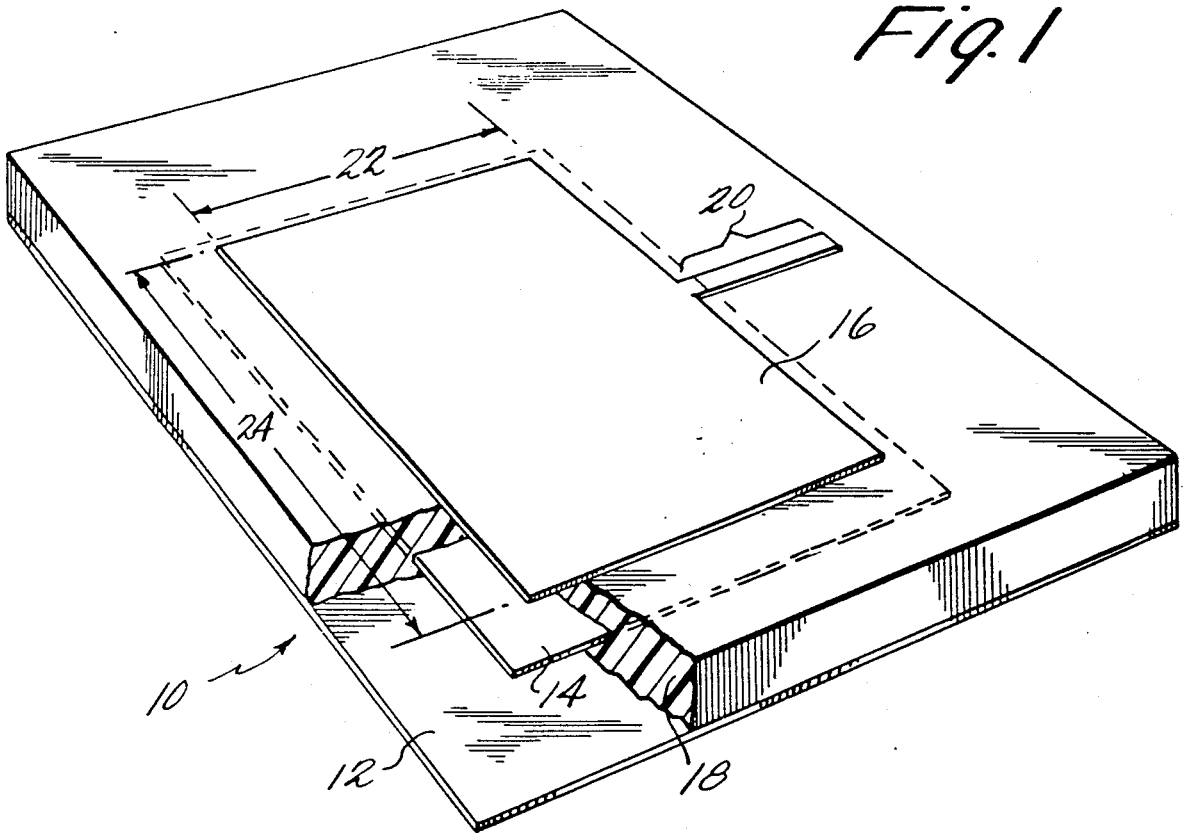
FIG. 1 is a perspective partially cut away view of a first exemplary embodiment of this invention.

The microstrip radiator 10 as shown in FIG. 1 comprises a ground or reference plane of conductive surface area 12 and a first electrically conducting radiator element 14 overlying and spaced from the ground plane 12 as well as a second electrically conducting radiator element 16 which, in turn, overlies the first radiator element 14 and is spaced therefrom. As shown in FIG. 1, the radiator elements 14 and 16 are spaced from one another and from the ground plane surface 12 by a dielectric material 18. Typically, the structure shown in FIG. 1 may be realized by first forming a microstrip radiator 14 and ground plane 12 in a conventional fashion and then laminating that with another microstrip radiator structure 16, which second microstrip structure has been formed without any ground plane. The exemplary apparatus shown in FIG. 1 is actually the simplest form of this particular exemplary embodiment since, it will be more fully appreciated from the following discussion, there may be more than two successively stacked radiator elements thereby correspondingly multiplying the number of multiple resonances exhibited by the antenna of structure 10.

In the preferred embodiment, the topmost radiator (radiator element 16 in FIG. 1) is driven with a conventional microstrip feed line 20. As will be appreciated, any other form of transmission line might also be utilized if desired. In this preferred form of the invention, the remaining radiator elements disposed between the topmost element and the ground plane (i.e. element 14 in FIG. 1) remain passive in the sense that there is no actual transmission line such as transmission line 20 connected thereto. As will be later discussed, other embodiments of the invention may also comprise feeding other of the intermediate elements.

Although the radiator elements of the FIG. 1 embodiment are not physically connected by an electrical conducter, there is, nevertheless, mutual coupling between the various elements and between the ground plane by virtue of their close proximity and by virtue of electromagnetic fields that are set up between the plates and/or between the lower most plate and the underlying ground plane 12. It is understood, of course, that the radio frequency signals are conducted to/from the antenna structure via the microstrip feed line 20 or some other suitable transmission means which is a reference to the ground plane 12. If the radio frequency signals involved occur at a resonant frequency of one of the radiator elements, then that element will respond by absorbing or radiating (depending upon whether the antenna structure is being used for reception or transmission respectively) radio frequency energy. At the same time, other non-resonant radiator elements will actually couple such energy from/to the resonant element. Non-resonant elements will couple inductively at frequencies below their resonant frequency and will couple capacitively at frequencies above their respective resonant frequency. Such inductive and capacitive coupling will be explained with respect to the embodiment of FIG. 1 in more detail by later reference to FIGS. 2 and 3.

As will be appreciated by those in the art, microstrip radiators are presently known in many different shapes. This invention is believed to be applicable to the use of such microstrip radiators, per se, of any shape. However, to simplify the explanation of this invention, rectangular radiators have been illustrated in a purely exemplary manner. Accordingly, the radiator elements 14 and 16 in FIG. 1 may take on any shape which resonates at the required frequency for that particular element. As shown in FIG. 1, the microstrip feed line 20 is connected to the longer side of the microstrip radiator 16. The resonant dimension 22 may be either a full electrical wavelength, a half electrical wavelength or a quarter electrical wavelength if, in the latter case, the radiating elements are shorted to ground along the edge at one end of the resonant dimension as will be appreciated. Further explanation of this latter embodiment will be given subsequently with respect to FIG. 4.

Although not shown in FIG. 1, it should also be noted that another feed line could be attached to the shorter dimension of the rectangular radiator element 16 so as to feed resonant dimension 24 at a lower frequency. It will also be appreciated that the resonant dimensions 22 and 24 may approximate equality with such element being effectively fed in phase quadrature on adjacent sides to produce substantially circularly polarized radiation. A corner fed circular polarized radiator 16 is also possible as are other types of radiator elements, per se, as should be appreciated. This invention contemplates the use of any such type of radiator element per se, even through rectangular radiator elements are shown in the exemplary FIGURES herein.

Radiator element 14 in FIG. 1 is constructed similar to element 16 but larger so as to define correspondingly scaled resonant frequencies. The largest radiator element 14 is located nearest the ground plane 12 with other successively smaller elements being stacked in the order of their resonant frequencies. Preferably, the smallest and topmost radiator element will be the driven element connected with the transmission feed line.

By symmetrically disposing the successive radiators one on top of the other, the radiated phase center for the antenna structure 10 will remain in the same physical location for each resonant frequency regardless of which radiator element happens to be resonant. Such symmetrical disposition of the elements eliminates pattern distortion often encountered with other multiply resonant devices. However, it should be noted that such centering is not absolutely critical and, furthermore, that it may be actually desirable under some conditions to purposely misalign the element centers thus purposely and knowingly distorting the pattern of the antenna structure 10 for various resonant frequencies.

Figure 2:
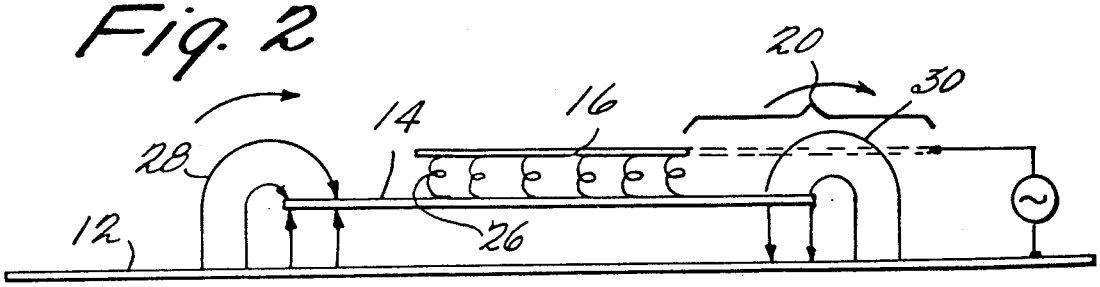
FIG. 2 is a schematic cross-section of the FIG. 1 embodiment useful for explaining the operation thereof.
Figure 3:
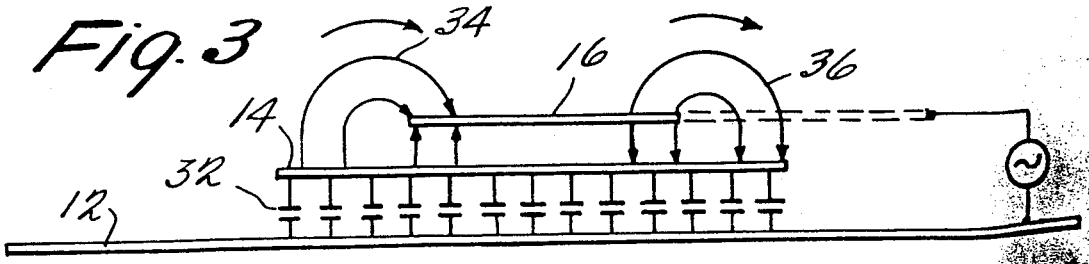
FIG. 3 is a schematic cross-section of the FIG. 1 embodiment also useful for explaining another mode of operation thereof.

FIGS. 2 and 3 represent a typical half wavelength resonant model of the FIG. 1 embodiment of this invention. The radiator elements 14 and 16 are effectively connected in series through the electro-magnetic field that exists between them. At the lower resonant frequency of element 14, FIG. 2 is applicable. Here, element 16 is operating below its resonant frequency so that it is effectively coupled through electro-magnetic fields to element 14 by a small inductive reactance 26. Such coupling therefore actually becomes part of the radio frequency feed means for connecting element 14 with the transmission line 20. Radiation fields 28, 30 are excited then in a conventional fashion between element 14 and the ground plane 12 as should be appreciated.

At the higher resonant frequency of element 16, FIG. 3 is applicable. Here, element 14 is operating above its resonant frequency so that it is capacitively coupled to ground plane 12 via an effective capacitance 32. Therefore, element 14 now effectively becomes an extension of the ground plane 12 and conventional radiation fields 34, 36 are excited between the microstrip radiator 16 and element 14 which now acts as an extension of the ground plane 12. Thus, in this instance, the non-resonant element 14 has again effectively become part of the feed means for exciting the radiation fields 34, 36 about the microstrip radiator 16.

The embodiment of the invention shown in FIG. 4 is substantially similar to that already described with respect to FIG. 1 except that the resonant dimension 38 in FIG. 4 is one-fourth wavelength and a shorting wall 40 has been provided for commonly connecting the upper element 42 and lower element 44 to ground plane 46. Furthermore, as may be seen in FIG. 4, all of the radiator elements have been shifted so as to have one extremity of the resonant dimension in a common plane with shorting wall 40.

FIG. 5 is a more generalized embodiment having N radiating elements as shown. Since these elements are not shorted to ground at one side thereof, the corresponding resonant dimensions 48 would be substantially one-half or one wavelength. Furthermore, the embodiment shown in FIG. 5 provides for multiple feeds 1-N to the various radiating elements. Of course, only the topmost feed number one need be utilized as described above. Nevertheless, for some applications, it may be advantageous to provide separate feeds to one or more of the intermediate radiator elements as shown in FIG. 5.

The spacing between the radiator elements is not critical as long as it is substantially less than one quarter wavelength and is typically on the order of one-sixteenth to one-eighth of an inch. In the preferred embodiment, the inner element spacings are all equal since the composite antenna structure is formed by laminating several similar individually constructed radiator elements and their associated dielectric substrates. However, since such spacing is not critical, other than equal inner element spacings may also be utilized as desired.

Although only a few exemplary embodiments of this invention have been specifically described above, those in the art will appreciate that many variations and modifications may be made in the exemplary embodiment without substantially departing from the unique and novel features of this invention. Accordingly, all such variations and modifications are intended to be included within the scope of this invention as defined by the following appended claims.

What is claimed is:

1. A multiple resonance radio frequency antenna structure of the microstrip type comprising:

an electrically conductive reference surface, a plurality of successively stacked electrically conductive element surfaces disposed above said reference surface, said plurality of element surfaces being successively disposed one on top of the other, each element surface defining a radiating aperture between its periphery and the next underlying conductive surface, each element surface being differently dimensioned than other surfaces so as to resonate at a different respectively corresponding radio frequency such that any one of a plurality of different radio frequencies may be utilized depending upon the activation of a corresponding desired one of said surfaces as an active element so as to produce radiation from the respectively corresponding radiating aperture defined between its periphery and the next underlying conductive surface, each element surface being spaced from each other and from said reference surface with a dielectric layer, and feed means electrically connected to at least one but not all of said element surfaces at a free edge portion thereof for conducting radio frequency signals to/from antenna structure, said radio frequency signals being electromagnetically coupled through the stacked element surfaces with nonresonant elements coupling inductively below their resonant frequency and coupling capacitively above their resonant frequency to activate a resonant element not directly conductively connected to said radio frequency signals.

2. A multiple resonance radio frequency antenna structure as in claim 1 wherein said element surfaces are dimensioned so as to cause said resonant radio frequency of each successive element surface to increase over that for the just preceding element surface lying thereabove.

3. A multiple resonance radio frequency antenna structure as in claim 2 wherein each successive element surface is smaller than the just preceding element surface and wherein each succeeding element is positioned so as to lie substantially within the underlying boundaries of the just preceding element.

4. A multiple resonance radio frequency antenna structure as in claim 3 wherein each successive element is substantially symmetrically disposed with respect to at least one dimension within the underlying boundaries of the just preceding element.

5. A multiple resonance radio frequency antenna structure as in claim 1 wherein at least one of said element surfaces is dimensioned to electrically resonate at a plurality of radio frequencies.

6. A multiple resonance radio frequency antenna structure as in claim 1 wherein said dielectric sheets comprise portions of a laminated dielectric structure substantially encasing said element surfaces except for the element surface spaced the farthest from said reference surface.

7. A multiple resonance radio frequency antenna structure as in claim 1 wherein said feed means comprises a microstrip transmission line which is an integral continuation of at least one of said element surfaces.

8. A multiple resonance radio frequency antenna structure of the microstrip type comprising:

an electrically conductive reference surface, a first electrically conductive element surface overlying said reference surface, a first layer of dielectric material being disposed between said reference surface and said first element surface so as to space such surfaces apart from one another and thereby define a first radiating aperture between the periphery of the first element surface and the reference surface, said first element surface being dimensioned to electrically resonate and to produce radiation from said first radiating aperture at a first radio frequency, a second electrically conductive element surface overlying said first element surface, a second layer of dielectric material being disposed between said first element surface and said second element surface so as to space such surfaces apart from one another and thereby define a second radiating aperture between the periphery of the second element surface and the underlying first element surface, said second element surface being dimensioned to electrically resonate and to produce radiation from said second radiating aperture at a second radio frequency different from said first radio frequency, and feed means directly connected to only a predetermined one of said element surfaces at a free edge portion thereof by including electromagnetic coupling provided by the stacked relationship of said first and second element surfaces with a non-resonant element surface coupling inductively below its resonant frequency and coupling capacitively above its resonant frequency for selectively supplying radio frequency electrical signals to/from said first and second element surfaces depending upon whether said electrical signals are at said first or second radio frequencies respectively such that said first surface is automatically activated as a radiator at said first radio frequency and said second surface is automatically activated as a radiator at said second radio frequency.

9. A multiple resonance radio frequency antenna structure as in claim 8 wherein at least one of said element surfaces is dimensioned to electrically resonate at a plurality of radio frequencies.

10. A multiple resonance radio frequency antenna structure as in claim 8 wherein said sheets of dielectric material comprise portions of a laminated dielectric structure substantially encasing said element surfaces except for the element surface spaced the farthest from said reference surface.

11. A multiple resonance radio frequency antenna structure as in claim 8 wherein said feed means comprises a microstrip transmission line which is an integral continuation of at least one of said element surfaces.

12. A multiple resonance radio frequency antenna structure of the microstrip type comprising:

an electrically conductive reference surface, a plurality of successively stacked electrically conductive element surfaces disposed above said reference surface, each element surface defining a radiating aperture between its periphery and the next underlying conductive surface, each element surface being dimensioned to resonate and to produce radiation from its respectively corresponding radiating aperture at a different radio frequency, each element surface being spaced from each other and from said reference surface with a dielectric sheet, feed means electrically directly connected to at least one but not to all of said element surfaces at a free edge portion thereof for conducting radio frequency signals to/from said antenna structure with said radio frequency signals being electromagnetically coupled through the stacked element surfaces with non-resonant elements coupling inductively below their resonant frequency and coupling capacitively above their resonant frequency to activate a resonant element surface, said element surfaces being dimensioned to have a substantially one-quarter electrical wavelength dimension at their respective resonant frequencies, and electrical shorting means electrically connecting together said element surfaces with said reference surface at one extremity of said one-quarter wavelength dimensions thereof.

13. A multiple resonance radio frequency antenna structure of the microstrip type comprising:

an electrically conductive reference surface, a plurality of successively stacked electrically conductive element surfaces disposed above said reference surface, each element surface defining a radiating aperture between its periphery and the next underlying conductive surface, each element surface being dimensioned to resonate and to produce radiation from its respectively corresponding radiating aperture at a different radio frequency, each element surface being spaced from each other and from said reference surface with a dielectric sheet, and feed means electrically connected to at least one but not to all of said element surfaces at a free edge portion thereof for conducting radio frequency signals to/from said antenna structure with said radio frequency signals being electromagnetically coupled through the stacked element surfaces with nonresonant element surfaces being coupled inductively below their resonant frequency and capacitively above their resonant frequency to activate a resonant element surface, said feed means comprising an electrical conductor electrically connected to the element surface spaced farthest from said reference surface.

14. A multiple resonance radio frequency antenna structure of the microstrip type comprising:

an electrically conductive reference surface, a plurality of successively stacked electrically conductive element surfaces disposed above said reference surface, each element surface defining a radiating aperture between its periphery and the next underlying conductive surface, each element surface being dimensioned to resonate and to produce radiation from its respectively corresponding radiating aperture at a different radio frequency, each element surface being spaced from each other and from said reference surface with a dielectric sheet, and feed means electrically connected to at least one but not to all of said element surfaces at a free edge portion thereof for conducting radio frequency signals to/from said antenna structure with said radio frequency signals being electromagnetically coupled through the stacked element surfaces with non-resonant element surfaces coupling inductively below their resonant frequency and coupling capacitively above their resonant frequency to activate a resonant element surface, said feed means comprising a plurality of electrical conductors separately connected to respectively corresponding ones of said element surfaces.

15. A multiple resonance radio frequency antenna structure of the microstrip type comprising:

an electrically conductive reference surface, a first electrically conductive element surface overlying said reference surface, a first sheet of dielectric material being disposed between said reference surface and said first element surface so as to space such surfaces apart from one another and thereby define a first radiating aperture between the periphery of the first element surface and the reference surface, said first element surface being dimensioned to electrically resonate and to produce radiation from said first radiating aperture at a first radio frequency, a second electrically conductive element surface overlying said first element surface, a second sheet of dielectric material being disposed between said first element surface and said second element surface so as to space such surfaces apart from one another and thereby define a second radiating aperture between the periphery of the second element surface and the underlying first element surface, said second element surface being dimensioned to electrically resonate and to produce radiation from said second radiating aperture at a second radio frequency different from said first radio frequency, and feed means connected directly to only one of said element surfaces at a free edge portion thereof but including electromagnetic coupling provided by the stacked relationship of said first and second element surfaces with a non-resonant element surface coupling inductively below its resonant frequency and coupling capacitively above its resonant frequency for automatically supplying radio frequency electrical signals to/from said first and second element surfaces, said first and second element surfaces being dimensioned so as to cause said first radio frequency to be less than said second radio frequency.

16. A multiple resonance radio frequency antenna structure of the microstrip type comprising:

an electrically conductive reference surface, a first electrically conductive element surface overlying said reference surface, a first sheet of dielectric material being disposed between said reference surface and said first element surface so as to space such surfaces apart from one another and thereby define a first radiating aperture between the periphery of the first element surface and the reference surface, said first element surface being dimensioned to electrically resonate and to produce radiation from said first radiating aperture at a first radio frequency, a second electrically conductive element surface overlying said first element surface, a second sheet of dielectric material being disposed between said first element surface and said second element surface so as to space such surfaces apart from one another and thereby define a second radiating aperture between the periphery of the second element surface and the underlying first element surface, said second element surface being dimensioned to electrically resonate and to produce radiation from said second radiating aperture at a second radio frequency different from said first radio frequency, feed means directly connected to only one of said element surfaces at a free edge portion thereof but including electromagnetic coupling provided by the stacked relationship of said first and second element surfaces with a non-resonant element surface coupling inductively below its resonant frequency and coupling capacitively above its resonant frequency for supplying radio frequency electrical signals to/from said first and second element surfaces, said first and second element surfaces being dimenionsed to have a substantially one-quarter electrical wavelength dimension at their respective resonant frequencies, and electrical shorting means electrically connecting together said element surfaces with said reference surface at one extremity of said one-quarter wavelength dimensions thereof.

17. A multiple resonance radio frequency antenna structure of the microstrip type comprising:

an electrically conductive reference surface, a first electrically conductive element surface overlying said reference surface, a first sheet of dielectric material being disposed between said reference surface and said first element surface so as to space such surfaces apart from one another and thereby defining a first radiating aperture between the periphery of the first element surface and the reference surface, said first element surface being dimensioned to electrically resonate and to produce radiation from said first radiating aperture at a first radio frequency, a second electrically conductive element surface overlying said first element surface, a second sheet of dielectric material being disposed between said first element surface and said second element surface so as to space such surfaces apart from one another and thereby defining a second radiating aperture between the periphery of the second element surface and the underlying first element surface, said second element surface being dimensioned to electrically resonate and to produce radiation from said second radiating aperture at a second radio frequency different from said first radio frequency, and feed means connected to only one of said element surfaces at a free edge portion thereof but including electromagnetic coupling provided by the stacked relationship of said first and second element surfaces with a non-resonant element surface coupling inductively below its resonant frequency and coupling capacitively above its resonant frequency for supplying radio frequency electrical signals to/from said first and second element surfaces, said feed means comprising an electrical conductor electrically connected to the element surface spaced the farthest from said reference surface.

18. A multiple resonance radio frequency antenna structure of the microstrip type comprising:

an electrically conductive reference surface, a first electrically conductive element surface overlying said reference surface, a first sheet of dielectric material being disposed between said reference surface and said first element surface so as to space such surfaces apart from one another and thereby defining a first radiating aperture between the periphery of the first element surface and the reference surface, said first element surface being dimensioned to electrically resonate and to produce radiation from said first radiating aperture at a first radio frequency, a second electrically conductive element surface overlying said first element surface, a second sheet of dielectric material being disposed between said first element surface and said second element surface so as to space such surfaces apart from one another and thereby define a second radiating aperture between the periphery of the second element surface and the underlying first element surface, said second element surface being dimensioned to electrically resonate and to produce radiation from said second radiating aperture at a second radio frequency different from said first radio frequency, and feed means connected to only one of said element surfaces at a free edge portion thereof but including electromagnetic coupling provided by the stacked relationship of said first and second element surfaces with a non-resonant element surface coupling inductively below its resonant frequency and coupling capacitively above its resonant frequency for supplying radio frequency electrical signals to/from said first and second element surfaces, said feed means comprising a plurality of electrical conductors connected to respectively corresponding ones of said element surfaces.

19. A microstrip antenna comprising:

an electrically conductive reference surface, a plurality of differently dimensioned parallel electrically conductive radiator surfaces disposed parallel to said reference surface but spaced thereabove, said plural radiator surfaces being disposed one on top of the other and mutually spaced one from another, and radio frequency feed means connected to at least one but not to all of said radiator surfaces at a free edge portion thereof for conducting radio frequency signals to/from said microstrip antenna, said radio frequency signals being electromagnetically coupled through the stacked radiator surfaces with nonresonant surfaces coupling inductively below their resonant frequency and coupling capacitively above their resonant frequency so as to activate a resonant radiator surface even though it may not be directly connected to said feed means.

20. A microstrip antenna as in claim 19 wherein said radiator surfaces are dimensioned so as to cause said resonant radio frequency of each successive radiator surface to increase over that for the just preceding radiator surface lying thereabove.

21. A microstrip antenna as in claim 20 wherein each successive radiator surface is smaller than the just preceding radiator surface and wherein each succeeding radiator is positioned so as to lie substantially within the underlying boundaries of the just preceding radiator.

22. A microstrip antenna as in claim 21 wherein each successive radiator is substantially symmetrically disposed with respect to at least one dimension within the underlying boundaries of the just preceding radiator.

23. A microstrip antenna as in claim 19 wherein at least one of said radiator surfaces is dimensioned to electrically resonate at a plurality of radio frequencies.

24. A microstrip antenna as in claim 19 wherein said feed means comprises a microstrip transmission line which is an integral continuation of at least one of said radiator surfaces.

* * * * *

UNITED STATES PATENT OFFICE

CERTIFICATE OF CORRECTION

Patent No. 4,070,676 Dated January 24, 1978

Inventor(s) Gary G. Sanford

It is certified that error appears in the above-identified patent and that said Letters Patent are hereby corrected as shown below:

Column 5, line 55, change "thereabove" to --therebelow--.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*